US006907704B2

(12) United States Patent
Abang Ali et al.

(10) Patent No.: US 6,907,704 B2
(45) Date of Patent: Jun. 21, 2005

(54) INTERLOCKING MORTARLESS LOAD BEARING BUILDING BLOCK SYSTEM

(75) Inventors: Abang Abdullah B. Abang Ali, Selangor Darul Ehsan (MY); Mohammed Razali B. Abdul Kadir, Selangor Darul Ehsan (MY); Mohd. Saleh B. Jafar, Selangor Darul Ehsan (MY); Abdul Aziz B. Abdul Samad, Selangor Darul Ehsan (MY); Rahinah Bt. Ibrahim, Selangor Darul Ehsan (MY)

(73) Assignees: Universiti Putra Malaysia, Selangor (MY); Kementerian Perumahan & Kerajaan Tempatan, Kuala Lumpur (MY)

( * ) Notice: Subject to any disclaimer, the term of this patent is extended or adjusted under 35 U.S.C. 154(b) by 0 days.

(21) Appl. No.: 09/834,187

(22) Filed: Apr. 12, 2001

(65) Prior Publication Data

US 2002/0007610 A1 Jan. 24, 2002

(30) Foreign Application Priority Data

Apr. 12, 2000 (MY) ..... PI 20001555

(51) Int. Cl.[7] ..... E04C 2/04

(52) U.S. Cl. ..... 52/605; 52/606; 52/503; 52/421

(58) Field of Search ..... 52/284, 421, 424, 52/425, 503, 569, 599, 604, 605, 606

(56) References Cited

U.S. PATENT DOCUMENTS

| | | | | |
|---|---|---|---|---|
| 868,838 | A | * | 10/1907 | Brewington |
| 900,753 | A | * | 10/1908 | Mahler |
| 2,493,547 | A | * | 1/1950 | Paolella |
| 2,684,589 | A | * | 7/1954 | Perreton |
| 3,036,407 | A | * | 5/1962 | Dixon |
| 3,888,060 | A | | 6/1975 | Haener |
| 4,107,894 | A | * | 8/1978 | Mullins |
| 4,640,071 | A | | 2/1987 | Haener |
| 5,575,128 | A | * | 11/1996 | Haener |
| 6,226,951 | B1 | * | 5/2001 | Azar |

* cited by examiner

*Primary Examiner*—Naoko Slack
(74) *Attorney, Agent, or Firm*—Wolf, Greenfield & Sacks, P.C.

(57) ABSTRACT

The present invention relates to an interlocking modular block system for mortarless wall assembly. A plurality of blocks are laid up in courses in a staggered relationship in which three different block configurations are provided, namely stretcher, corner and half block units. The stretcher and corner blocks have lengths at least one and a half times the width, and the half block has the same width and a length which is half the length of the stretcher and corner blocks. The invention offers a simple and fast construction procedure, even when using unskilled labor.

30 Claims, 9 Drawing Sheets

INTERLOCKING MORTARLESS LOAD BEARING BUILDING BLOCK SYSTEM

RELATED APPLICATIONS

This application claims priority under 35 U.S.C. §119 from Malaysian patent application serial number PI 20001555, filed Apr. 12, 2000.

TECHNICAL FIELD OF THE INVENTION

The present invention generally relates to construction materials and, more particularly to a mortarless load bearing building block system of an improved type.

BACKGROUND OF THE INVENTION

Conventional concrete block walls are laid up by a time-consuming difficult procedure which involves troweling a layer of concrete mortar onto a level concrete or stone base or the like, or the top of a course of previously laid blocks and then setting blocks one at a time in the mortar layer, in each instance also applying mortar to the end walls of each block to join the blocks together. This procedure is continued until the required number of courses are laid. Great care must be taken to keep each course perfectly horizontal and straight. Few people have the skill to carry out such a procedure in a competent manner, therefore the cost of such construction is always high.

Various types of interlocking blocks have been devised in the past to facilitate the construction of block walls and other structures. Most such blocks have been very expensive to produce since the interlocking portions, usually grooves or protrusions, are normally cut into the blocks after they have been formed by molding. Moreover, it is difficult to maintain the required tight tolerances for accurate construction of large walls or other structures through the molding and cutting steps. The prior blocks often required additional finishing or grinding steps to meet the required tolerances.

Interlocking mortarless building blocks overcoming many of these deficiencies are described in U.S. Pat. Nos. 3,888,060 and 4,640,071. Those blocks have been used successfully for many years. These blocks are assembled in courses, with the block joints staggered and continuous vertical open cells into which reinforcing bars and wet concrete can be inserted. While highly effective, these blocks require that the reinforcing bar be inserted in lower courses, with blocks in later courses lifted over the ends of the reinforcing bar as the structure advances and wet concrete is periodically poured into the cells containing the reinforcing bar.

Thus installing blocks over the reinforcing bar can be a significant problem with tall structures.

Therefore, there is a continuing need for improvements in mortarless building block systems to permit lower cost block manufacture, and lower cost and more rapid structure assembly from the blocks. It would also be desirable to be able to provide an improved mortarless building block system featuring improved adaptability, strength and economy. The design of the block should be such that it can be readily molded and released from the forming mold with full detail preserved, obviating any subsequent reshaping, finishing, etc. Further, the block should be easily strengthened with reinforcing materials, if needed, and be capable of being fabricated in a full array of sizes and shapes.

SUMMARY OF THE INVENTION

Accordingly, it is the object of the present invention to provide an interlocking modular block system for mortarless wall assembly.

This and other objectives of the present invention are accomplished in one aspect of the invention by providing an interlocking modular block system for mortarless wall assembly in which a plurality of blocks are laid up in courses in a staggered relationship wherein three different block configurations are provided, the first and second blocks (stretcher and corner blocks) having lengths at least one and a half times the width, and the third block (half block) having the same width and a length up to half the length of the stretcher and corner blocks, said blocks comprising a pair of spaced, parallel, upright sidewalls having flat top and bottom surfaces, said sidewalls having block-interlocking means; a first transverse end wall extending between said sidewalls at a first end of said blocks; and a second transverse end wall extending between said sidewalls spaced from a second end of said blocks.

According to another aspect, the invention provides an interlocking modular block system for mortarless wall assembly in which a plurality of blocks are laid up in courses in a staggered relationship wherein the stretcher block comprises: a pair of spaced, parallel, upright sidewalls (1, 2) having flat top and bottom surfaces, said sidewalls having block-interlocking means (3, 4, 5, 6) on opposed ends thereof; a first transverse, protruding end wall (7) extending between said sidewalls at a first end of said block; and a second transverse, protruding end wall (8) extending between said sidewalls spaced from a second end of said block.

According to still another aspect, the invention provides an interlocking modular block system for mortarless wall assembly in which a plurality of blocks are laid up in courses in a staggered relationship wherein the corner block comprises: a pair of spaced, parallel, upright sidewalls (9, 10) having flat top and bottom surfaces, said sidewalls having block-interlocking means (11, 12, 13, 14) on opposed ends thereof; a first transverse end wall (15) extending between said sidewalls at a first end of said block; a second transverse end wall (16) extending between said sidewalls spaced from a second end of said block; a transverse upright support web (17) spans said sidewalls, integral and defining a cavity for receiving cementitious material therein; and protrusions (18) on the inside of sidewalls, extending from a base substantially coplanar with said sidewall bottom surfaces and having tips extending above said sidewall top surfaces configured to interlock with a block in a next succeeding course.

According to a further aspect, the invention provides an interlocking modular block system for mortarless wall assembly in which a plurality of blocks are laid up in courses in a staggered relationship wherein the half block comprises: a pair of spaced, parallel, upright sidewalls (19, 20) having flat top and bottom surfaces, said sidewalls having block-interlocking means (21, 22); a first transverse end wall (23) extending between said sidewalls at a first end of said block; a second transverse end wall (24) extending between said sidewalls spaced from a second end of said block; and a protrusion (25) on the inside of said sidewalls, extending from a base substantially coplanar with said sidewall bottom surfaces and having a tip extending above said sidewall top surfaces configured to interlock with a block in a next succeeding course.

The interlocking modular block system according to the present invention enables construction of load-bearing and non-load bearing walls without using cement mortar layers between the building blocks. The system is also designed to withstand different types of stresses which may develop from the applied loads. In addition, the configurations of the unit blocks are simple, they are easily constructed, satisfy structural performance for residential buildings, up to five storeys, and the self-alignment features of the blocks enable fast construction even when using unskilled labor.

BRIEF DESCRIPTION OF THE DRAWINGS

Other aspects of the present invention and their advantages will be discerned after studying the detailed description in conjunction with the accompanying drawings in which:

FIG. 1 shows a Stretcher Block Unit.

FIG. 2 shows a Corner Block Unit.

FIG. 3 show a Half Block Unit.

FIG. 4 shows a procedure for constructing a wall with horizontal stiffener.

FIG. 5 shows a procedure for casting vertical ties.

FIG. 7 shows a procedure for constructing a wall with door opening.

FIG. 8 shows a procedure for constructing a wall with window opening.

DETAILED DESCRIPTION OF THE INVENTION

FIGS. 1, 2 and 3 show the perspective, side and top views of the stretcher, corner end half block units respectively, in accordance to the present invention.

Figure 1A:
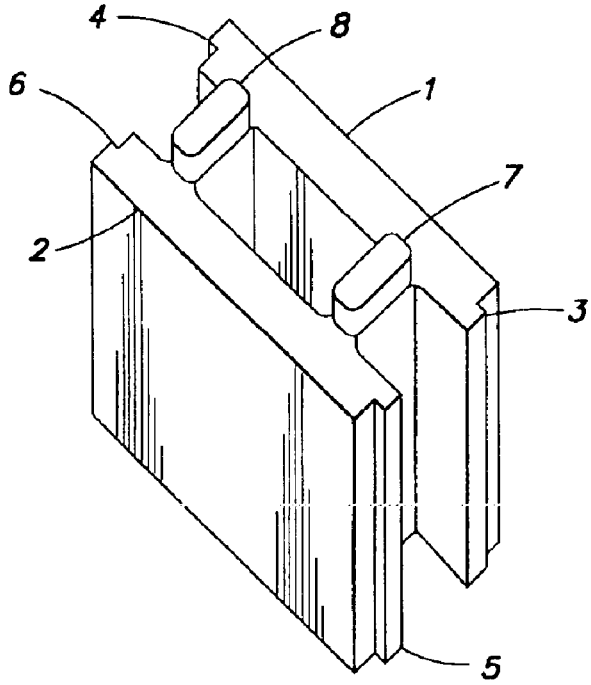
FIG. 1*a* is a perspective view of the stretcher block unit.
Figure 1B:
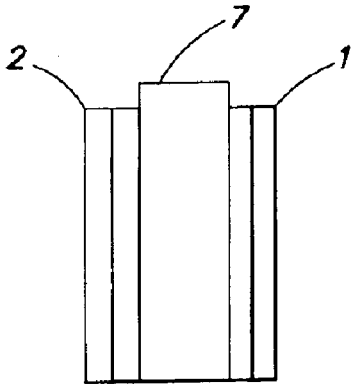
FIG. 1*b* is a side view of the stretcher black unit.
Figure 1C:
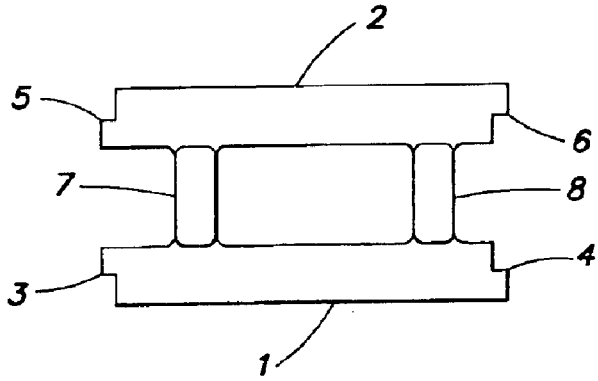
FIG. 1*c* is a top view of the stretcher block unit.

FIG. 1*a* shows the perspective view of the stretcher block unit. As can be seen from FIG. 1*a* there are a pair of sidewalls (1, 2), interlocking means (3, 4, 5, 6) on opposed ends of sidewalls, male interlocking means located at one end of the sidewalls and female interlocking means located on the opposite ends of the sidewalls, and a pair of transverse, protruding end walls (7, 8). FIG. 1*b* shows the side view of the stretcher block unit as seen from the side of transverse wall (7), while FIG. 1*c* shows the top view of the stretcher block unit.

Figure 2A:
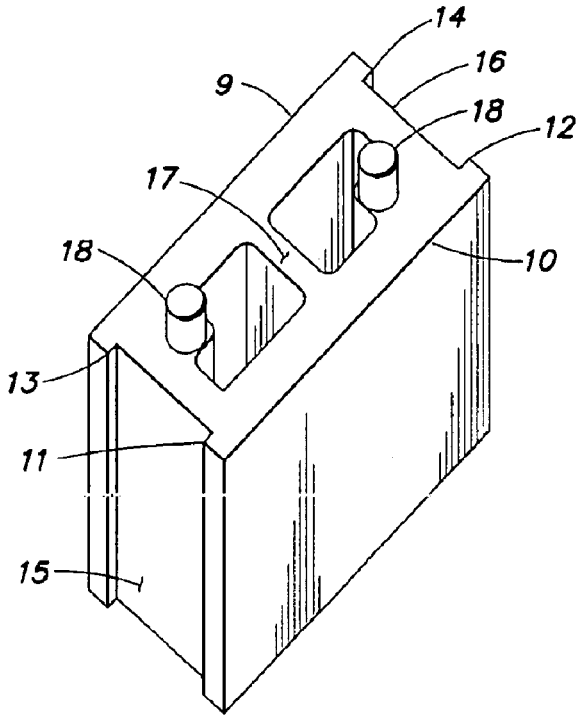
FIG. 2*a* is a perspective view of the corner block unit.
Figure 2B:
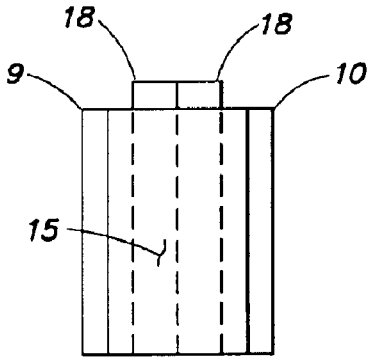
FIG. 2*b* is a side view of the corner block unit.
Figure 2C:
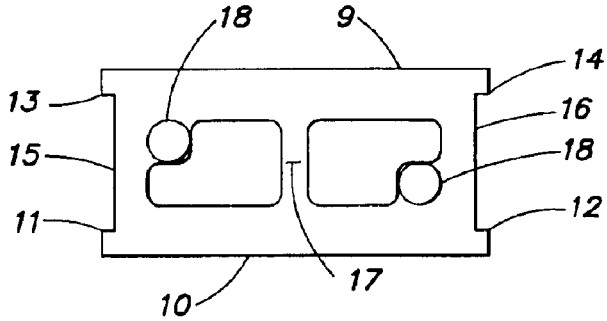
FIG. 2*c* is a top view of the corner block unit.

FIG. 2*a* shows the perspective view of the corner block unit. It shows a pair of sidewalls (9, 10), comprising interlocking means (11, 12, 13, 14), male interlocking means at one end of sidewalls and female interlocking means on the opposite ends of the sidewalls, a pair of transverse end walls (15, 16), a transverse web (17) and protrusions (18). FIG. 2*b* shows the side view of the corner block viewed from transverse wall (15) and FIG. 2*c* is the top view of the corner block unit.

Figure 3A:
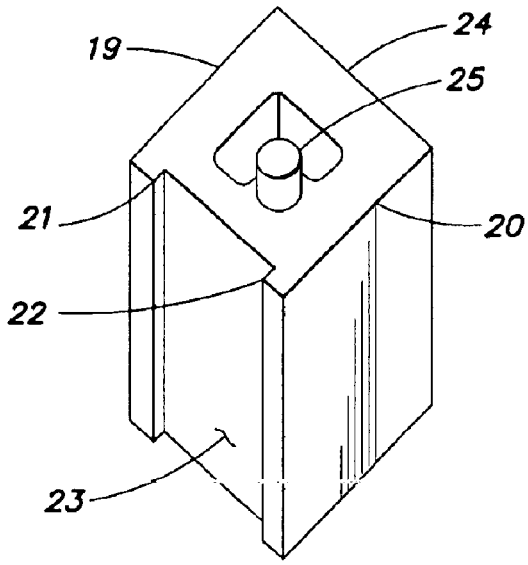
FIG. 3*a* is a perspective view of the half block unit.
Figure 3B:
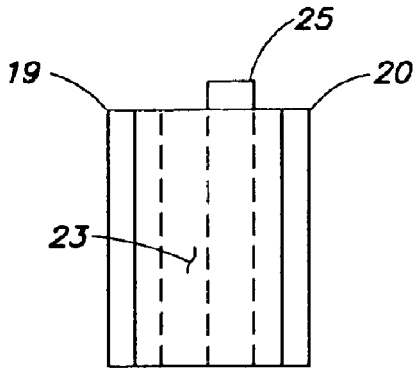
FIG. 3*b* is a side view of the half block unit.
Figure 3C:
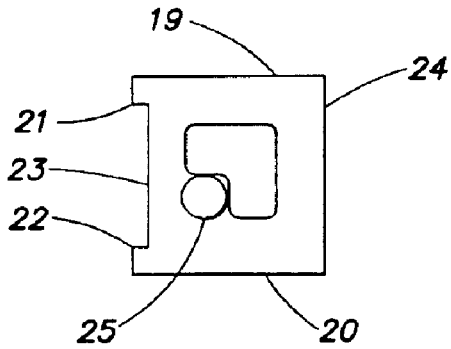
FIG. 3*c* is a top view of the half block unit.
Figure 4A:
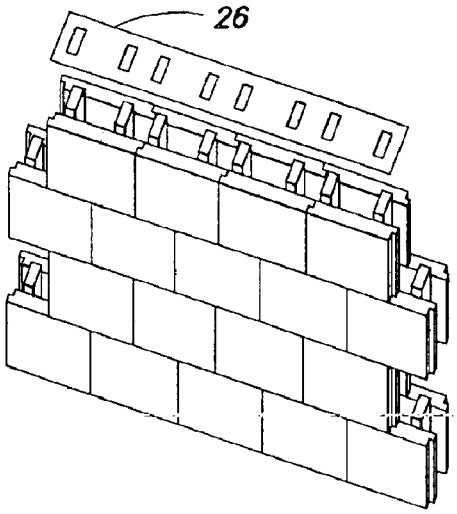
FIG. 4*a* shows placing the plastic sheet (26).
Figure 4B:
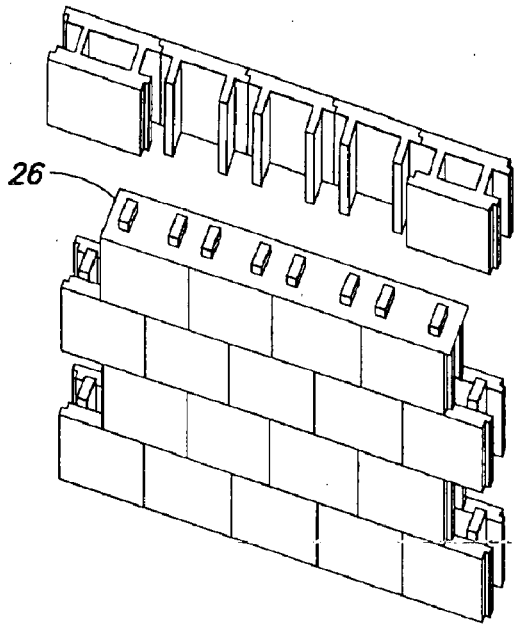
FIG. 4*b* shows laying the next course on the plastic sheet (26).
Figure 4C:
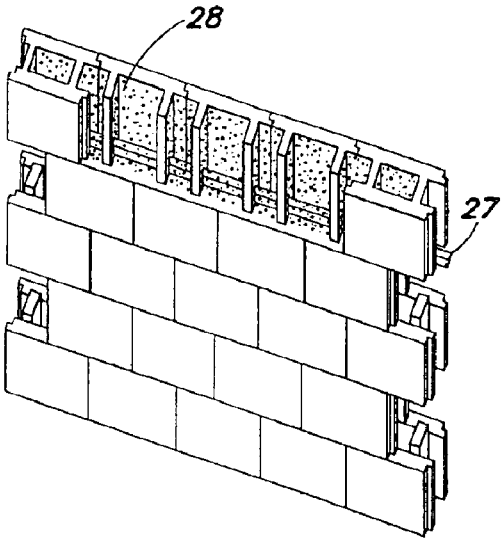
FIG. 4*c* shows placing the steel (27) and casting the stiffener (28).
Figure 4D:
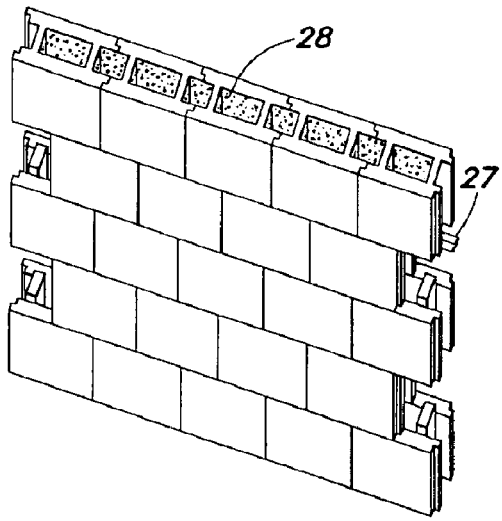
FIG. 4*d* shows the completed wall comprising a steel bar (27) and stiffener (28).

FIG. 3*a* shows the perspective view of the half block unit. This figure shows a pair of sidewalls (19, 20) comprising interlocking means (21, 22) located at one end of the sidewalls, a pair of transverse end walls (23, 24), and a protrusion (25). FIG. 3*b* shows the side view of the half block unit from the side of transverse wall (23), while FIG. 3*c* shows the top view of the half block unit.

The above-mentioned interlocking block units form building blocks for an interlocking modular system for construction of load-bearing and non-load-bearing walls without using cement mortar layers between the blocks. In addition, the interlocking mechanism in the horizontal plane is ensured by protrusions in the blocks ensuring connection between adjacent blocks above, below and at each end. The interlocking mechanism provided by the blocks has sufficient strength to resist different types of moments and sheer stresses which develop in load-bearing walls up to five-storey residential buildings, without cement mortar layers. Also, the blocks when assembled have self-alignment features through the provision of groove and tongue means on sidewalls and this results in rapid construction even when using unskilled labor.

Footing and First Course Construction

Two methods of construction are disclosed herein and the main objective of both is to provide very accurate level and alignment. The level of the floor and walkway is preferred to be at mid-height of the course to provide satisfactory restraint of the wall at the bottom.

(a) Casting of continuous footing for the whole structure following the levels that are given by the engineer. Starter bars of the vertical stiffeners must be fixed in position. A very smooth and even surface must be achieved to ease laying of the first course and the subsequent work can be performed as required. It is preferred to cast low grade concrete on both sides of the first course to prevent any movement of the block later on.

(b) Casting of continuous footing with relatively rough surface for the whole structure, requires that starter bars of the vertical ties must be fixed in position. After the initial setting of the concrete, the first course can be laid following the levels that are given by the engineer and to achieve that cement mortar is required underneath the blocks (conventional construction). As in the first method, the sides of the blocks must be supported by concrete of low grade.

Wall Construction

Figure 5A:
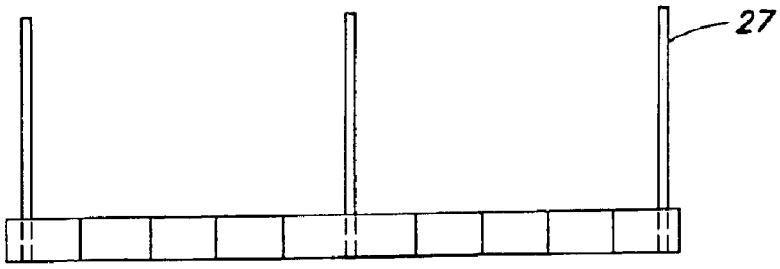
FIG. 5*a* shows laying and casting the first course.
Figure 5B:
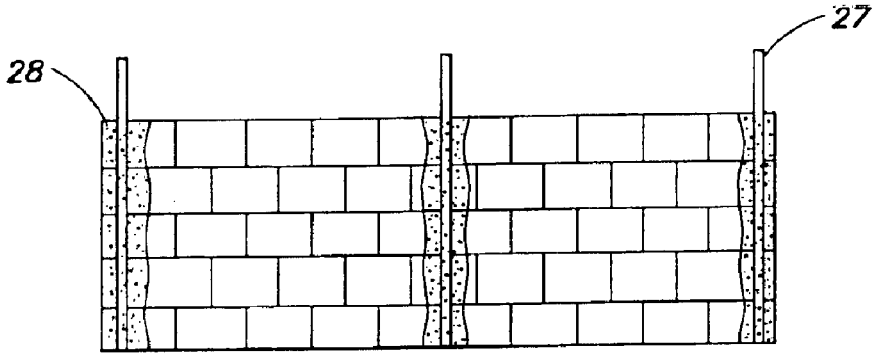
FIG. 5*b* shows constructing 1 meter masonry and casting the vertical stiffener (28).
Figure 5C:
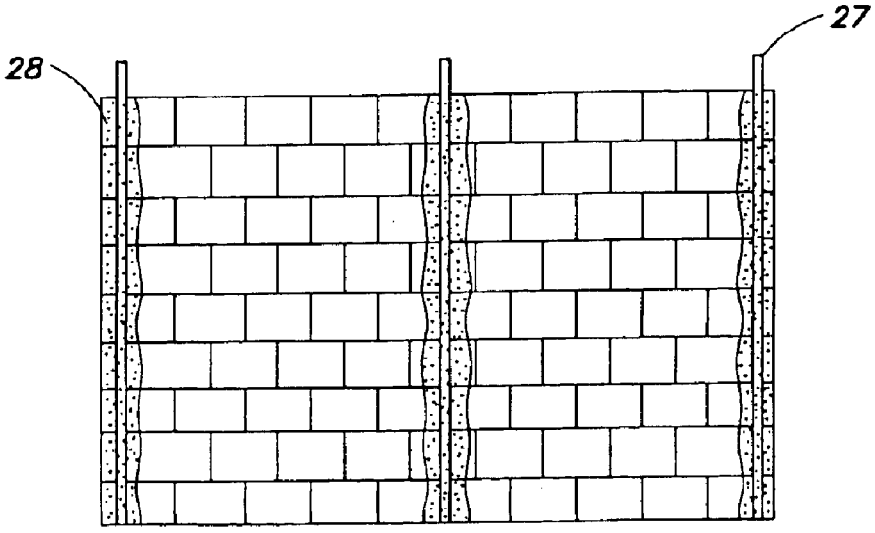
FIG. 5*c* shows casting the $2^{nd}$ meter of the stiffener (28). Steel is indicated as (27) and stiffener is indicated as (28).

Laying of the subsequent courses after the first course is carried out as required taking into consideration the following:

(a) Casting of the vertical ties is performed in stages, being one meter height for each stage, as shown in FIG. 5.

Figure 6C:
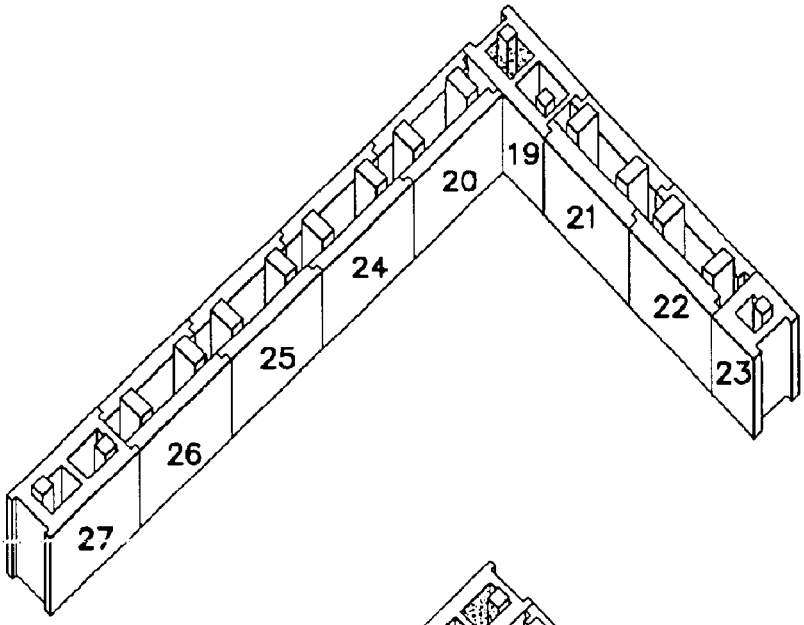
FIG. 6 shows an exploded view of the construction of a corner connection showing the arrangement of blocks in the (FIG. 6*a*) first, (FIG. 6*b*) second and (FIG. 6*c*) third courses.
Figure 6B:
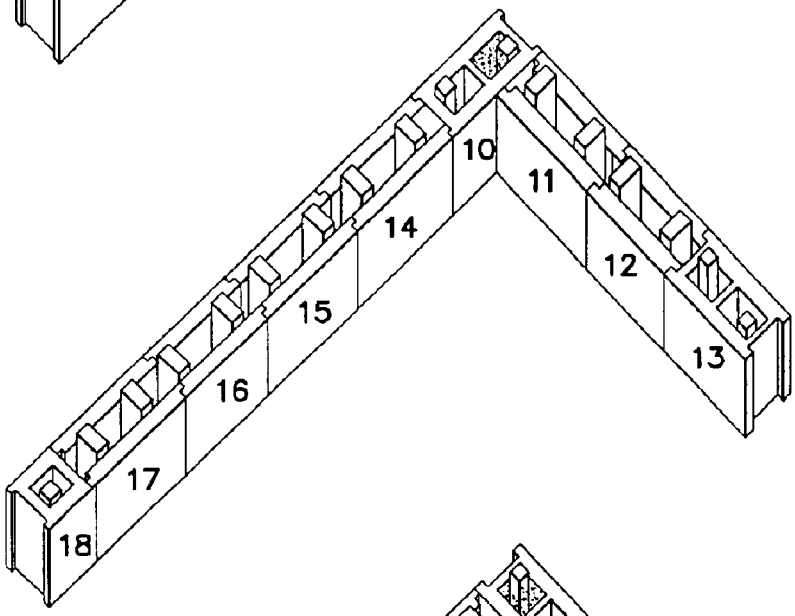
Figure 6A:
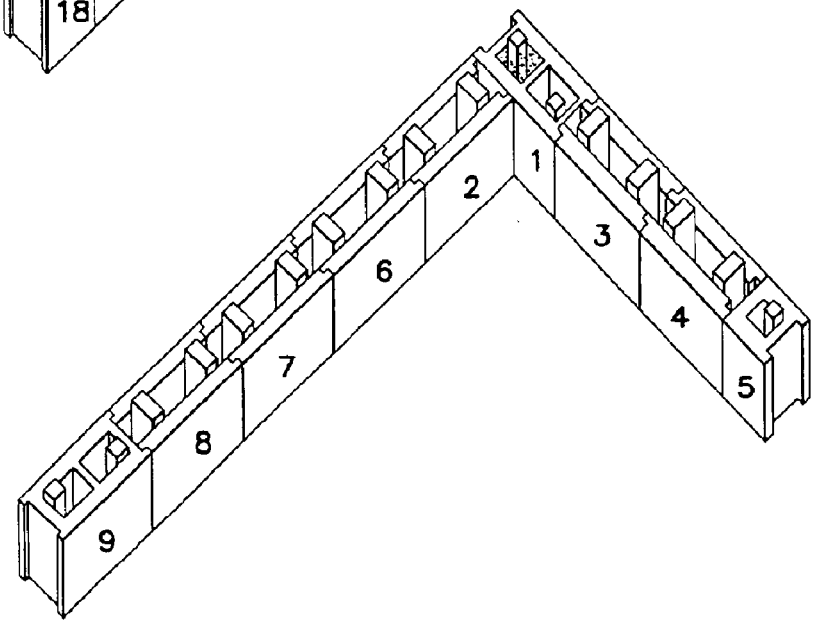
Figure 7A:
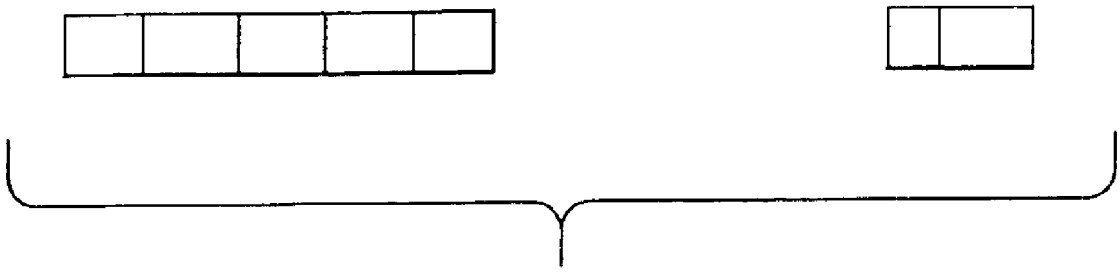
FIG. 7*a* shows laying the first course and identifying the door opening.
Figure 7B:
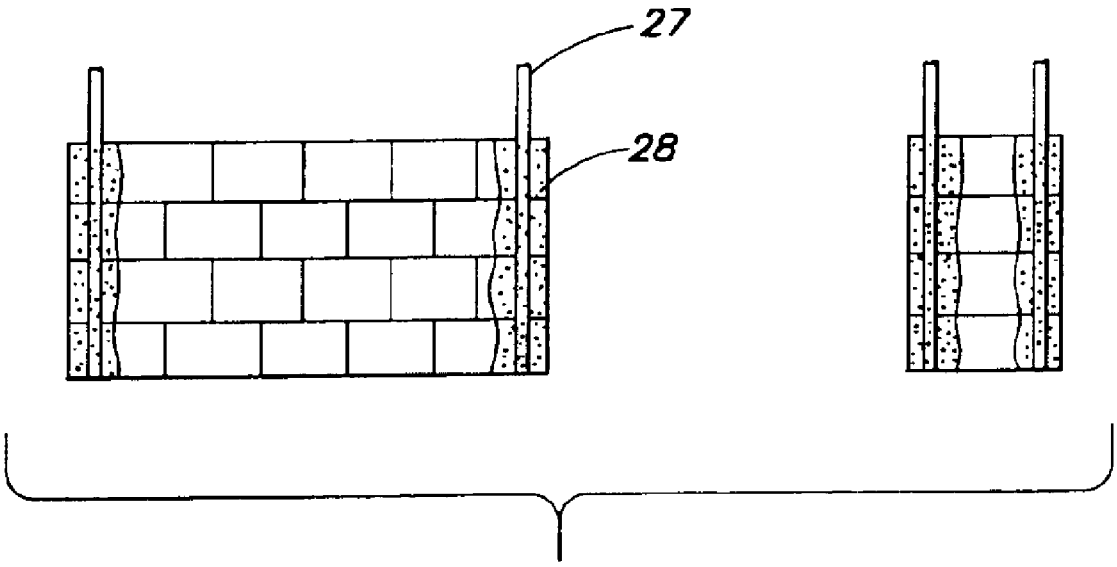
FIG. 7*b* shows constructing 1 meter masonry and casting vertical stiffeners (28).
Figure 7C:
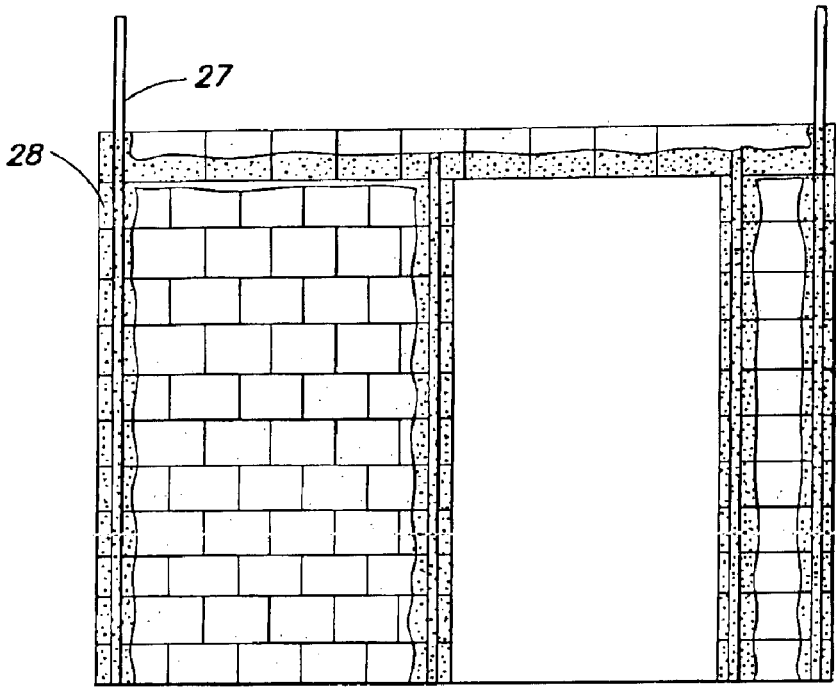
FIG. 7*c* shows casting the lintel.
Figure 7D:
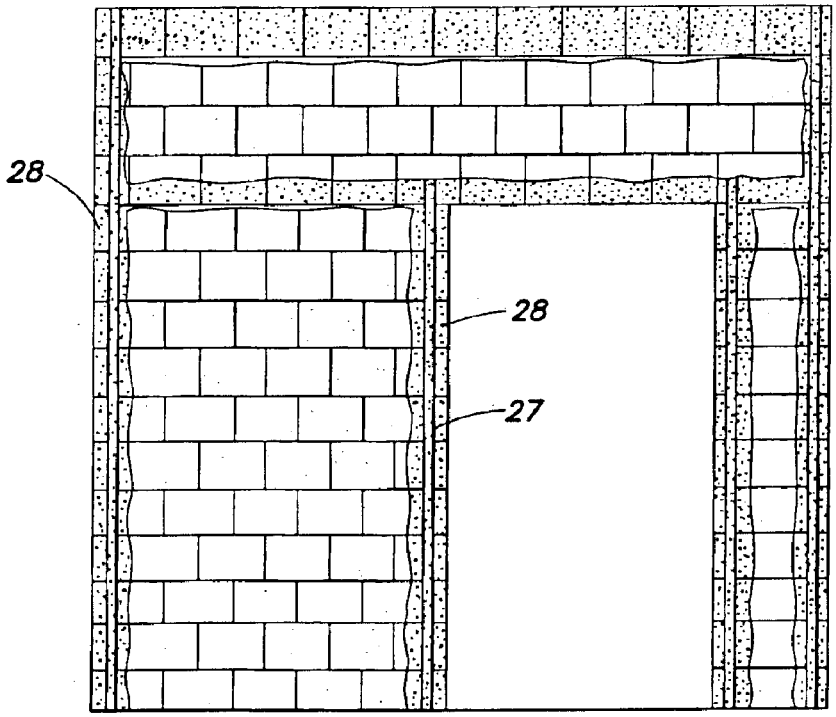
FIG. 7*d* shows the completed wall with door opening. Steel is indicated as (27) and stiffener is indicated as (28).

(b) Casting of vertical ties at each junction of the walls and at the ends of the walls as well, as shown in FIG. 6.

(c) Casting of horizontal ties and lintels of the openings when the level is reached.

(d) It is not preferred to erect the structures in different height: courses must be laid evenly for the whole structure.

(e) The verticality and the alignment of the walls, in addition to the dimensions must be checked for uniformity and preferably before casting of the ties.

FIG. 4 shows the procedure for constructing a wall with horizontal ties/stiffeners. These ties are provided at mid-height of walls, last course of walls, above the openings and below the openings. Short horizontal ties are recommended at T-junctions and cross-junctions to provide satisfactory integrity of the junctions. Construction of these ties require hacking the blocks from bottom to provide access for two bars reinforcement to be placed and these ties also require thin plastic sheet below the blocks to serve as permanent form work for the concrete. The height of these ties is preferred not to be less than 100 mm. For the ties at the openings and the top ties, it is preferable to be at the same height of the block (200 mm). FIG. 4 shows the detail of the construction procedure.

FIG. 5 shows the procedure for casting vertical ties. These stiffeners are provided at the corners, ends of walls, T-junction, cross-junction, and around the openings as well. Two bars will be placed in each stiffener. Construction of this type of stiffener is carried out in stages at one meter high for each stage. Concrete of the same grade as the block is recommended but wet concrete is preferable so that there is no vibration. Stiffeners are necessary to provide connectivity between walls and foundation, walls and floors, and to handle the concentration of the load of the roof truss. FIG. 5 shows the detail of the construction procedure.

FIG. 6 shows the procedure for the construction of a corner connection. The steps for assembling blocks at a corner connection are as follows:

(a) Placement of blocks starts with block no. 1 and the sequence of laying the blocks are numbered as shown in FIG. 6. Block no. 10 is the start for the second course and block no. 19 is the start of the third course.

(b) Vertical stiffeners are constructed at junctions formed by corner blocks e.g., blocks nos. 1, 10 and 19, using in-situ concrete.

Generally, all walls of the structure will contain not less than three vertical stiffeners and not less than two horizontal ties.

FIG. 7 shows the procedure for constructing a wall with door opening. Generally, all openings will be surrounded with two vertical and two horizontal stiffeners. Standard dimensions of doors recommend the height to be 2.1 m and for this purpose the level of the floor is preferred to be at mid-height of the first course, hence there will be proper matching at the top. Openings for doors are provided as in the conventional method and the doors are fixed accordingly. Lintels are erected in the same way as horizontal stiffeners but it needs timber support during construction. FIG. 7 shows the detail for construction of door opening.

Figure 8A:
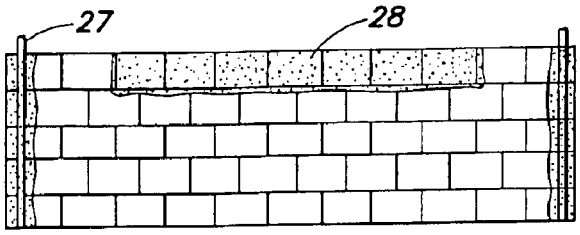
FIG. 8*a* shows constructing 1 meter masonry and casting the vertical stiffeners, with horizontal stiffener below a window.
Figure 8B:
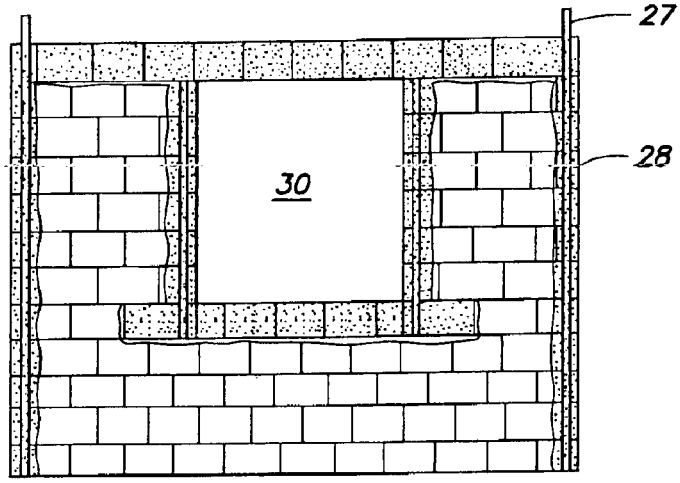
FIG. 8*b* shows constructing the $2^{nd}$ meter of the wall and casting the lintel.
Figure 8C:
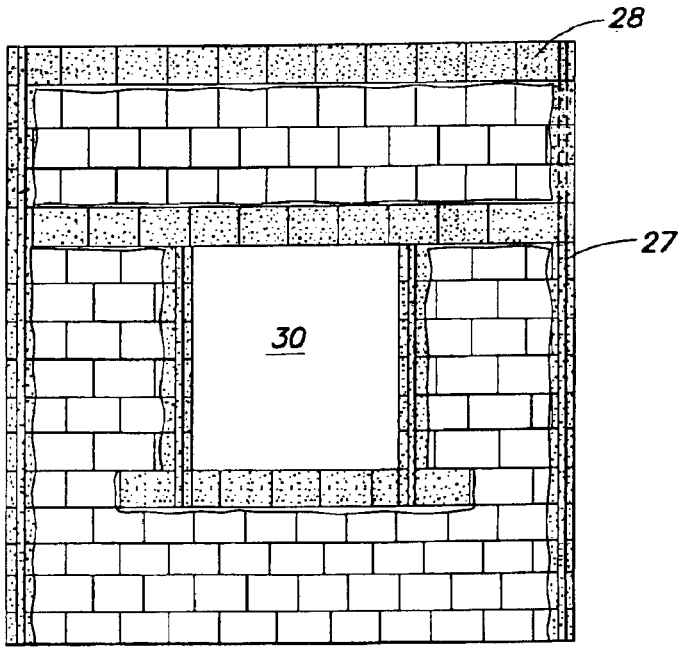
FIG. 8*c* shows the completed wall with window opening. Steel is indicated as (27) and stiffener is indicated as (28).

FIG. 8 shows the procedure for constructing a wall with window opening. The procedure for construction of window opening is the same as for door opening and in addition it requires a horizontal tie at the bottom of the window. FIG. 8 shows the detail for the construction of the wall with window opening.

While the preferred embodiments of the present invention have been described, it should be understood that various changes, adaptations and modifications may be made thereto. It should be understood, therefore, that the invention is not limited to details of the illustrated invention shown in the figures and that variations in such minor details will be apparent to one skilled in the art.

We claim:

1. An interlocking modular block system for mortarless wall assembly, comprising:

a plurality of blocks laid up in courses in a staggered relationship, wherein three different block configurations are provided, a stretcher block and a corner block having lengths at least one and a half times the width, and a half block having the same width of the stretcher block and the corner block and a length up to half the length of the stretcher block and the corner block, each of said blocks comprising:

a pair of spaced, parallel, upright sidewalls having flat top and bottom surfaces, said sidewalls having block-interlocking means;

a first transverse end wall extending between said sidewalls spaced from a second end of said blocks; and a second transverse end wall extending between said sidewalls spaced from a second end of said blocks;

wherein, in the corner block, said sidewalls have block-interlocking means on opposed ends thereof.

2. The interlocking modular block system according to claim 1 wherein, in the stretcher block:

said sidewalls have block-interlocking means on opposed ends thereof;

the first transverse end wall is a protruding end wall extending between said sidewalls spaced from a first end of said stretcher block; and the second transverse end wall is a protruding end wall extending between said sidewalls spaced from the second end of said stretcher block.

3. The interlocking modular block system for mortarless wall assembly according to claim 2, wherein the block-interlocking means comprises male and female interlocking means.

4. The interlocking modular block system for mortarless wall assembly according to claim 3 wherein the male and female interlocking means provide self-alignment features to the block system for mortarless wall assembly.

5. The interlocking modular block system for mortarless wall assembly according to claim 2, wherein the blocks provide void space to house stability and stiffening means in both horizontal and vertical directions.

6. The interlocking modular block system for mortarless wall assembly according to claim 2, wherein the blocks provide for the construction of door and window openings.

7. The interlocking modular block system for mortarless wall assembly according to claim 2, wherein the blocks are used to house lintels without requiring the use of form work.

8. The interlocking modular block system for mortarless wall assembly according to claim 2, wherein the blocks provide for the construction of load and non-load bearing walls.

9. The interlocking modular block system according to claim 1 wherein, in the corner block:

the first transverse end wall extends between said sidewalls at a first end of said corner block;

the second transverse end wall extends between said sidewalls spaced from the second end of said corner block; the corner block further comprising:

a transverse upright support web spanning between said sidewalls, integral to the sidewalls, and defining a cavity for receiving cementitious material therein; and protrusions on the inside of sidewalls, extending from a base substantially coplanar with said sidewall bottom surfaces and having tips extending above said sidewall top surfaces configured to interlock with a block in a next succeeding course.

10. The interlocking modular block system for mortarless wall assembly according to claim 9, wherein the block-interlocking means comprises male and female interlocking means.

11. The interlocking modular block system for mortarless wall assembly according to claim 10, wherein the male and female interlocking means provide self-alignment features to the block system for mortarless wall assembly.

12. The interlocking modular block system for mortarless wall assembly according to claim 9, wherein the blocks provide void space to house stability and stiffening means in both horizontal and vertical directions.

13. The interlocking modular block system for mortarless wall assembly according to claim 9, wherein the blocks provide for the construction of door and window openings.

14. The interlocking modular block system for mortarless wall assembly according to claim 9, wherein the blocks are used to house lintels without requiring the use of form work.

15. The interlocking modular block system for mortarless wall assembly according to claim 9, wherein the blocks provide for the construction of load and non-load bearing walls.

16. The interlocking modular block system for mortarless wall assembly of claim 9, wherein the transverse upright support web is of substantially uniform thickness.

17. The interlocking modular block system according to claim 1 wherein, in the half block:

said sidewalls having block-interlocking means at one end of said sidewalls;

the first transverse end wall extends between said sidewalls at a first end of said half block;

the second transverse end wall extends between said sidewalls spaced from a second end of said half block; the half block further comprising:

a protrusion on the inside of said sidewalls, extending from a base substantially coplanar with said sidewall bottom surfaces, said protrusion having a tip extending above said sidewall top surfaces and configured to interlock with a block in a next succeeding course.

18. The interlocking modular block system for mortarless wall assembly according to claim 17, wherein the block-interlocking means comprises male and female interlocking means.

19. The interlocking modular block system for mortarless wall assembly according to claim 18 wherein the male and female interlocking means provide self-alignment features to the block system for mortarless wall assembly.

20. The interlocking modular block system for mortarless wall assembly according to claim 17, wherein the blocks provide void space to house stability and stiffening means in both horizontal and vertical directions.

21. The interlocking modular block system for mortarless wall assembly according to claim 17, wherein the blocks provide for the construction of door and window openings.

22. The interlocking modular block system for mortarless wall assembly according to claim 17, wherein the blocks are used to house lintels without requiring the use of form work.

23. The interlocking modular block system for mortarless wall assembly according to claim 17, wherein the blocks provide for the construction of load and non-load bearing walls.

24. The interlocking modular block system for mortarless wall assembly according to claim 1 wherein the block-interlocking means comprises male and female interlocking means.

25. The interlocking modular block system for mortarless wall assembly according to claim 24 wherein the male and female interlocking means provide self-alignment features to the block system for mortarless wall assembly.

26. The interlocking modular block system for mortarless wall assembly according to claim 1 where the blocks provide void space to house stability and stiffening means in both horizontal and vertical directions.

27. The interlocking modular block system for mortarless wall assembly according to claim 1 wherein the blocks provide for the construction of door and window openings.

28. The interlocking modular block system for mortarless wall assembly according to claim 1, wherein the blocks are used to house lintels without requiring the use of form work.

29. The interlocking modular block system for mortarless wall assembly according to claim 1, wherein the blocks provide for the construction of load and non-load bearing walls.

30. An interlocking modular block system for mortarless wall assembly, comprising:

a plurality of blocks laid up in courses in a staggered relationship, wherein three different block configurations are provided, a stretcher block and a corner block having lengths at least one and a half times the width, and a half block having the same width of the stretcher block and the corner block and a length up to half the length of the stretcher block and the corner block, each of said blocks comprising:

a pair of spaced, parallel, upright sidewalls having flat top and bottom surfaces, said sidewalls having block-interlocking means;

a first transverse end wall extending between said sidewalls spaced from a second end of said blocks; and a second transverse end wall extending between said sidewalls spaced from a second end of said blocks;

wherein, in the stretcher block:

said sidewalls have block-interlocking means on opposed ends thereof;

the first transverse end wall is a protruding end wall extending between said sidewalls spaced from a first end of said stretcher block; and the second transverse end wall is a protruding end wall of substantially uniform thickness extending between said sidewalls spaced from the second end of said stretcher block.

* * * * *